US006116955A

United States Patent [19]

Lazaro, Jr.

[11] Patent Number: 6,116,955

[45] Date of Patent: Sep. 12, 2000

[54] EMI TERMINATING AND GROUNDING STRAIN RELIEF CLAMP ASSEMBLY

[75] Inventor: Luis J. Lazaro, Jr., Shoreline, Wash.

[73] Assignee: The Boeing Company

[21] Appl. No.: 09/149,209

[22] Filed: Sep. 8, 1998

Related U.S. Application Data

[63] Continuation-in-part of application No. 09/034,562, Mar. 3, 1998, which is a continuation-in-part of application No. 08/986,378, Dec. 8, 1997, Pat. No. 5,989,065, which is a continuation-in-part of application No. 08/687,082, Jul. 23, 1996, abandoned, which is a continuation-in-part of application No. 08/521,776, Aug. 31, 1995, abandoned, which is a continuation-in-part of application No. 08/435,122, May 5, 1995, abandoned.

[51] Int. Cl.[7] ..... H01R 9/03

[52] U.S. Cl. ..... 439/610; 439/98

[58] Field of Search ..... 439/98, 607–610, 439/95, 99, 101, 108, 589

[56] References Cited

U.S. PATENT DOCUMENTS

| | | | |
|---|---|---|---|
| 3,609,632 | 9/1971 | Vetter | 439/609 X |
| 3,678,445 | 7/1972 | Brancaleone | 439/609 |
| 4,423,919 | 1/1984 | Hillis | 439/609 |
| 5,267,878 | 12/1993 | Shinji et al. | 439/610 |
| 5,580,278 | 12/1996 | Fowler et al. | 439/321 X |

*Primary Examiner*—Khiem Nguyen
*Attorney, Agent, or Firm*—Conrad O. Gardner

[57] ABSTRACT

An EMI terminating and grounding strain release clamp assembly or "backshell" is provided having male and female component members and coupling intermediate members constructed of conductive metals. Upon coupling of the female and male component members a split metallic ring is compressed and envelopes a termination platform with electrical cable shields enclosed in a BeCu wrap-around band. This joint connection produces an electrical grounding path which provides EMI protection. Assembly of the component parts is accomplished without the aid or use of a tool. A sealing member can be used for environmental protection of the backshell interior parts.

11 Claims, 3 Drawing Sheets

EMI TERMINATING AND GROUNDING STRAIN RELIEF CLAMP ASSEMBLY

CROSS-REFERENCE TO RELATED APPLICATIONS

This application is a continuation-in-part of application Ser. No. 09/034,562, filed Mar. 3, 1998, now pending, which is a continuation-in-part of Application Ser. No. 08/986,378, filed Dec. 8, 1997, now U.S. Pat. No. 5,989,065, which is a continuation-in-part of application Ser. No. 08/687,082, filed Jul. 23, 1996, now abandoned, which is a continuation-in-part of application Ser. No. 08/521,776, filed Aug. 31, 1995, now abandoned, which is a continuation-in-part of application Ser. No. 08/435,122, filed May 5, 1995, now abandoned.

BACKGROUND OF THE INVENTION

The present invention relates to an improved terminating and grounding strain release clamp assembly, sometimes called a "backshell", for electrical shielded cables and the like. Prior art such as usage of mechanical band dispersed from a banding tool as the means for joint connection between the "backshell" and terminated electrical cable shields, individual and/or overall, is error-prone, tedious, cumbersome and non-repairable assembly.

In some known application, such as today's fly-by-wire and/or HIRF configured airplane, an almost absolute minimum amount of EMI presence is critical to the airplane system performance. Simply stated, the electrical cable and/or wire shield grounding shall be continuous and free of contamination. The prior art banding assembly is totally impacted by the assembler disadvantage of not having enough "hands" to locate and position individual and/or overall cable shields while applying the mechanical band and then operating the banding tool. The prior art banding assembly almost consistently produced an unacceptable ground shield terminations such as high resistance, misalignment and improper location of the mechanical band, overlapping cable shield braids, loose mechanical band, etc. Another resultant problem is the susceptibility to environmental contamination. For example, when the cable shield is of nickel plating and the mechanical band is stainless steel and the termination platform on the backshell adapter is cadmuim plated, galvanic action amongst different metals produces corrosion. Another problem associated with the prior art banding assembly is the inherent nonrepairable shield termination which increases the airline's cost of ownership.

The present invention also eliminates the need for a tool and the user friendly assembly significantly improves the EMI performance, greatly reduces assembly cost, increases reliability and allows maintainability.

BRIEF SUMMARY OF THE INVENTION

It is an object of the present invention to overcome the aforementioned and other deficiencies and disadvantages of the prior art.

It is another object of the present invention to provide a strain relief adapter female member having a configured inner surface which engages the outer surface of a split compression ring causing a forceful engagement on the compression ring with a backshell adapter male member and the Backshell adapter having a slotted termination platform for cable shields.

A further object of the present invention is to utilize a conductive wrap-around band to collect, position, locate cable shields, individual and overall, onto the termination platform of the backshell adapter.

A still further object of the present invention is the coupling of the female and male component member to produce an electrical joint connection caused by the split compression ring closing onto the termination platform.

Yet another object of the invention is to eliminate galvanic action when the assembly has incompatible metals by using a wrap-around band as a barrier between metals.

It is also an object of the invention to provide a terminating and grounding strain relief clamp assembly which is tool free to assemble, reworkable and maintainable. The present invention provides a terminating and grounding strain release clamp assembly or "backshell" that comprises an interfitting metallic shell, housing and coupling parts such as a split compression ring and a metallic wrap-around band which when all joined together form an electrical conductive path with the cable shields to greatly reduced the presence of electromagnetic interference (EMI).

DETAILED DESCRIPTION OF THE INVENTION

Figure 1:
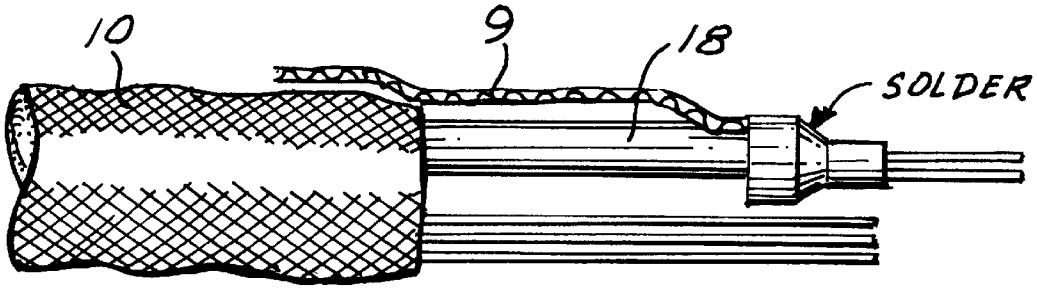
Fig. 1. (Prior Art)
FIG. 1 is a reference view to illustrate current art cable and/or wire shields, individual and overall, preparation.
Figure 2:
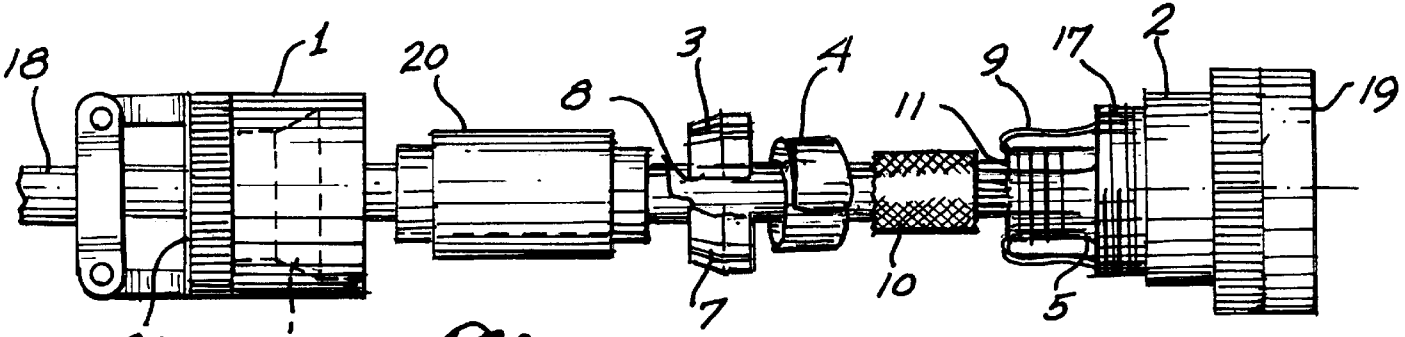
FIG. 2 is an exploded perspective view, made in accordance with the invention, of a terminating and grounding strain release clamp assembly or "backshell" having female and male component members, a split compression ring and wrap-around band and cable shields (as shown in FIG. 1) to be terminated thereto. Also shown is a cold shrinkable sieeving intended for sealing the cable entry area.
Figure 2A:
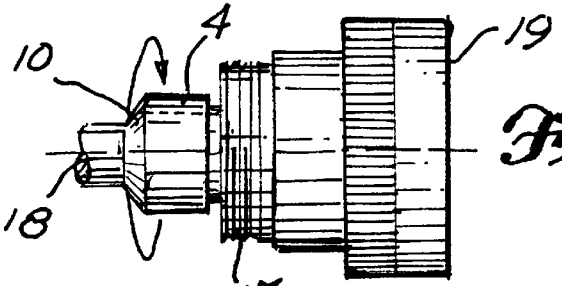
FIG. 2A is an end portion view of FIG. 2, showing both individual and overall cable shields fittingly enclosed by a wrap-around band at the termination platform of the male component member.
Figure 3:
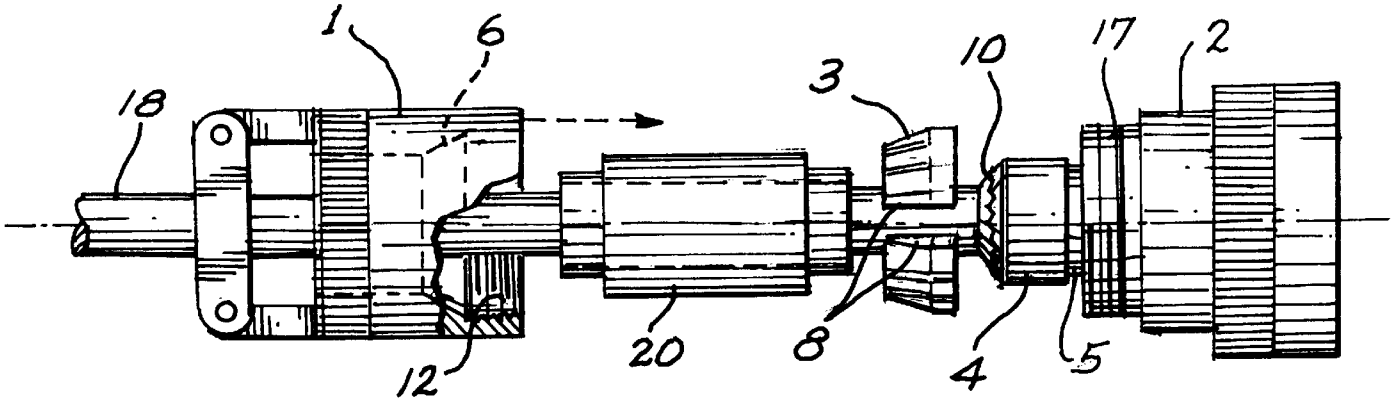
FIG. 3 is an exploded perspective view illustrating assembly of the terminating and grounding strain release clamp assembly made in accordance with the invention. The cold shrinkable sleeve will provide environmental protection to the assembly.
Figure 4:
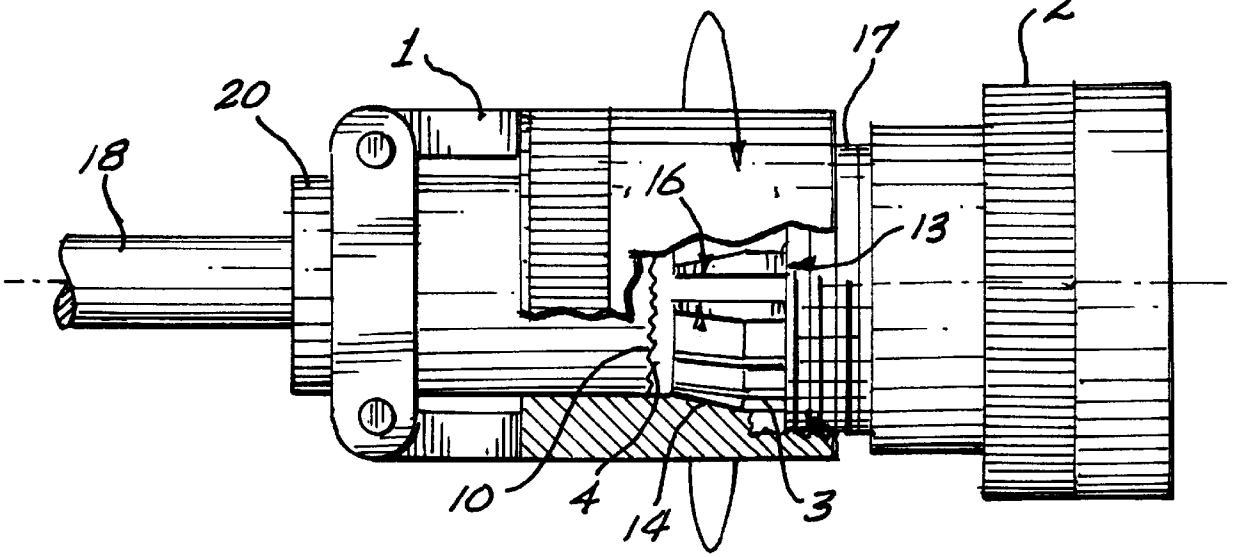
FIG. 4 is a side elevational view of the assembled backshell, a portion thereof being broken away to show the electrical junction formed by the interfitting metallic shell, housing and coupling parts all joined together with the terminated cable shields, individual and overall.

An exemplary embodiment of the invention, sometimes called a "backshell", is shown in FIG. 2 through FIG. 4. The exemplary backshell comprises a generally strain relief adapter 1 female component member, a backshell adapter 2 male component member, and a split compression ring 3 and wrap-around band 4 therebetween. For this description, a cold shrinkable sleeving 20 is used for sealing the cable entry area 20 of the strain relief adapter 1. The male component member 2 includes a slotted end 11, termination platform 5 and the female component member 1 having a tapered inner periphery or shoulder 6 intended to engaged the outer diameter 7 on the split compression ring 3. A wrap-around band 4 is provided to collect and positionally maintain terminated individual 9 cable shields on the slotted end 11 of the termination platform 5. The overall 10 cable shield is then pushed onto the termination platform 5 on the male component member 2 so that it makes an overlap on the individual 9 cable shields as shown in FIG. 2A. Coupling of the female component member 1 to the male component member 2 will cause shoulder 6 to abut on the split compression ring 3 simultaneously with the forceful engagement 13 on the compression ring 3 and the shoulder surface 15 on the termination platform 5 of the backshell adapter 2 male component member. This tightening 14 on the intermediate members brings the compression ring 3 to close its 70°–75° ends 8 to locked 16 onto the termination platform 5 of the male component member 2 as shown in FIGS. 3 and 4. It can be understood that this embodiment joint connection is now a junction which provides electrical continuity from the cable shields 9, 10 to the backshell. The strain relief adapter 1 female component member is defined by a tapered inner periphery or shoulder 6 behind its internal thread 12. While the two parts are shown axially separated in FIG. 2, the shoulder 6 will act on the outer diameter 7 of the split compression ring 3 upon coupling of the internal thread 12 in the female component member 1 to the external thread 17 in the male component member 2.

The backshell adapter 2 male component member includes a plug housing 19 with external thread 17 and having slotted 11 termination platform 5 for multiple individual shields 9 and overall shield 10 terminations. The slot 11 controls the location, spacing and positioning of each individual shields 9 on the termination platform 5. A BeCu wrap-around band 4 is included, more specifically, inserted around the termination platform 5 to collect and maintained location integrity of the assembled cable shields 9, 10. Also, on assembly where incompatible metals are to be coupled such as but not limited to, nickel plated overall cable shields 10 and tin plated individual shields 9 to the cadmuim plated termination platform 5, another piece of the wrap-around band 4 can be used to separate the incompatible metals.

In the use of the split compression ring 3, it is externally formed on the cable 18 of which its configured ends 8 have a 70°–75° taper which comes together when under compression. As described earlier, coupling of the strain relief 1 female adapter to the backshell adapter 2 male member forces the split compression ring to close and envelope 16 the termination platform 5 of the backshell adapter 2. This electrical joint connection is at its level best when the interfitting members are at locations 13 and 14 as shown on FIG. 4.

As will now be apparent, when the female component member 1 and male component member 2 are connected, without the use of a tool, a joint is formed between the cable shields 9, 10 and the backshell. Use of a cold shrinkable sleeving 20 to the assembly provides environmental protection at the cable entry area 21 of the strain relief adapter 1. The present invention provides a term inating and grounding strain release clamp assembly for electrical shielded cable 18 which produces a reliable and maintainable ground connection whose integrity is a result of the user friendly assembly. Another advantage of the invention is the versatility or means to separate incompatible metals which if not eliminated will cause corrosion and degrade the backshell low EMI immunity.

Figure 5:
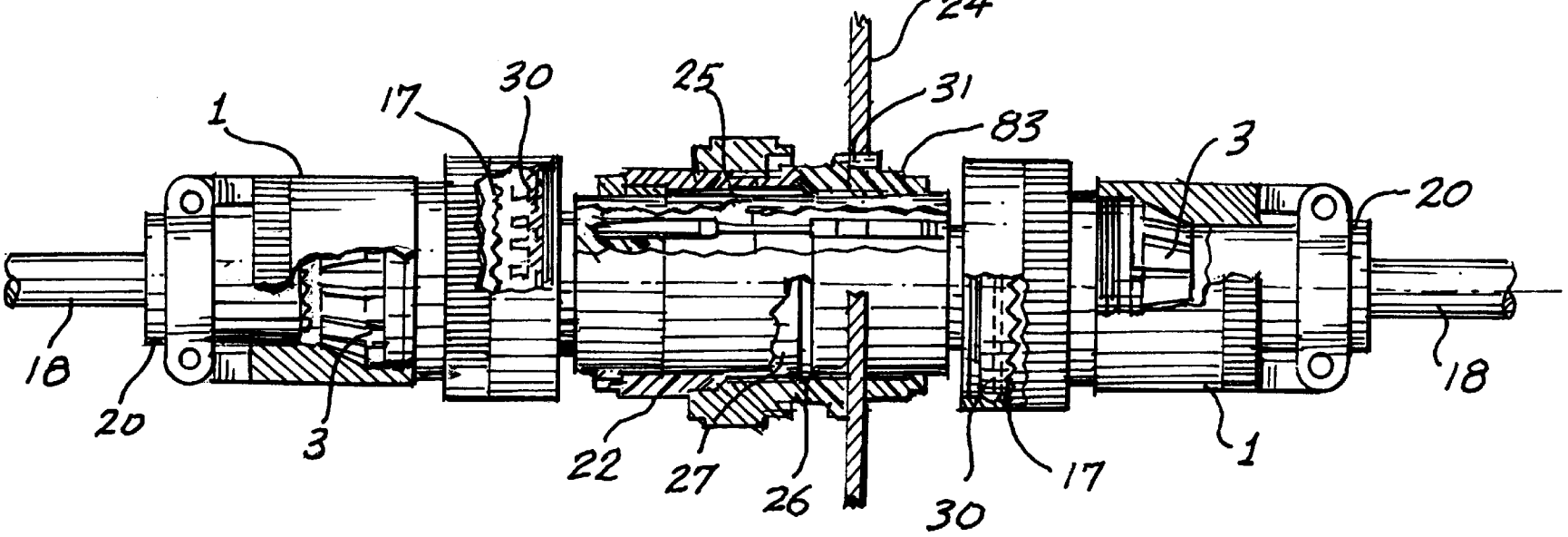
FIG. 5 is an isometric view of an integrated airplane connector bonding and grounding system illustrating the joint connection or continuity flow from the cable shields to the backshell (as described in the present embodiment) and with the addition of the spring contact fingers (as described on application Ser. No. 09/034,562) into the present embodiment ensures reliable interface connection between the present embodiment backshell and electrical connectors (Plug and Receptacle). The joint connection on the mated electrical plug and receptacle connector is achieved with the prior art usage of a grounding spring in the plug connector and for this illustration a new grounding finger is added onto the receptacle connector thus doubling the efficiency and reliability of the joint connection. Finally, an outwardly projecting grounding wave spring (as described on application Ser. No. 08/986,378) on the receptacle connector flange completes the shield ground loop on the airplane connector bonding and grounding system.

While the invention has been described with respect to a preferred embodiment, reference to application Ser. Nos. 08/986,378 and 09/034,562 for the parts represented by the legends identified in FIG. 5 may be made to show the present significantly improved, highly reliable and consistent airplane grounding and bonding system which is critical to the functional integrity on a "Fly-by-Wire and High Intensity Radio Frequency (HIRF)" configured airplane. For example and as illustrated in FIG. 5, the shielding continuity from the cable or wire shields is carried on to the present invention backshell while application Ser. No. 09/034,562 provides continuation of the described (shielding) electrical joint onto the mated electrical plug (22) and receptacle (23) connectors and application Ser. No. 08/986,378 closes the shield ground loop by extending the electrical joint connection onto the airplane panel and/or structure (24) with the usage of the projecting wave springs. To further clarify the electrical joint between the mated electrical plug (22) and receptacle (23) connectors, this is achieved through the grounding fingers (25) mounted on the plug (22) connector. The grounding fingers (25) can be easily damaged mechanically from severe metal-to-metal interference between grounding fingers (25) and receptacle (23) connector metal shell housing and/or contamination from aircraft fluids. A new embodiment to ensure reliable joint connection between plug (22) and receptacle (23) is the addition of a grounding wave spring (26) on the receptacle (23) connector. It can be understood that this grounding wave spring (26) is mounted or located behind the prior art interfacial sealing O-ring (27) in the receptacle connector therefore eliminating the damage problem discussed on the plug (22) and connector grounding fingers (25 ) as evidenced by joint connection between plug (22) and receptacle (23) connectors now achieved when plug (22) shell face is pushing against grounding wave spring (26) and having the grounding wave spring (26) behind the receptacle (23) O-ring (27) thereby eliminating fluid contamination.

Furthermore, various modifications and improvements may be made to the present embodiments without departing from the scope of the invention. Accordingly, it is to be understood that the invention is not to be limited by the specific illustrative embodiments, but only by the scope of the appended claims.

I claim:

1. In an EMI terminating and grounding strain release clamp assembly or "backshell" that terminates EMI shielded cable or wires, wherein the improvement comprises:

a strain relief adapter female component member constructed of metal and plated having a clamping outer end and housing, said housing including a tapered inner periphery or shoulder behind an internal coupling thread;

a backshell adapter male component member constructed of metal and plated having a slotted termination platform with an external thread for coupling with said strain relief adapter behind a plug housing with an annular recess formed around its inner surface and a spring contact grounding fingers located in the annular recess;

an electrically conductive wrap-around band positioned on the outer periphery of said termination platform;

an electrically conductive split compression ring located therebetween, said strain relief adapter and said backshell adapter and said split compression ring having an outer diameter and engaged by said shoulder on said strain relief adapter causing entrappement of said split compression ring forming a close connection on two ends thereof when said strain relief adapter and said backshell adapter are coupled.

2. The backshell of claim 1 including a junction means forming an electrically conductive interface between said EMI cable and/or wire shields and said coupled male and female component members.

3. The backshell of claim 1 including an electrically conductive junction means formed without the aid or use of a tool.

4. The backshell of claim 2 wherein the coupling of the said male and female component members produce a forcefull engagement on said split compression ring forming a joint connection on all the intermediate members.

5. The backshell of claim 4 wherein said strain relief adapter has a tapered inner surface or shoulder to engage said split compression ring.

6. The backshell of claim 1 wherein said backshell adapter has a slotted termination platform which locates and positions said EMI shielded wires on assembly.

7. The backshell of claim 1 wherein said wrap-around band is positionally maintained and collectively joins said EMI shields, individual and overall, in an envelope assembly at said termination platform.

8. The backshell of claim 7 wherein coupling of incompatible metals is not a constraint to the assembly and performance of said backshell when said wrap-around band is used to separate said metals.

9. The backshell of claim 8 wherein said wrap-around band is a BeCu material and acts as a barrier between Ni plated EMI overall shield and tin plated EMI individual shield or cadmium plated termination platform.

10. The backshell of claim 2 wherein said junction means comprises a metallic ring member.

11. The backshell of claim 10 wherein said split compression ring ends includes a 70°–75° taper closed around the outer periphery of said termination platform thereby providing an electrical grounding path to said terminated EMI cable and wire shields.

* * * * *